US008702537B2

(12) United States Patent
Cerbo

(10) Patent No.: US 8,702,537 B2
(45) Date of Patent: Apr. 22, 2014

(54) ALLBALL SPORT TEAM GAME

(75) Inventor: Anthony Michael Cerbo, Boonton, NJ (US)

(73) Assignee: Anthony M. Lerbo, III, Phoeniz, AZ (US)

( * ) Notice: Subject to any disclaimer, the term of this patent is extended or adjusted under 35 U.S.C. 154(b) by 217 days.

(21) Appl. No.: 13/332,798

(22) Filed: Dec. 21, 2011

(65) Prior Publication Data

US 2013/0165275 A1 Jun. 27, 2013

(51) Int. Cl.
*A63B 69/00* (2006.01)
*A63B 67/00* (2006.01)

(52) U.S. Cl.
USPC ..... 473/416; 473/422; 473/447; 473/472

(58) Field of Classification Search
CPC ..... A63B 63/00; A63B 63/083; A63B 2243/0004; A63B 2243/0037
USPC ..... 473/42, 416, 433, 447, 446, 470–472, 473/485, 422; 273/400, 402
See application file for complete search history.

(56) References Cited

U.S. PATENT DOCUMENTS 611,504 A * 9/1898 Perky ..... 273/400
1,211,379 A * 1/1917 Maisch ..... 273/368
3,134,594 A * 5/1964 Crowley ..... 273/350
3,244,420 A * 4/1966 Poynter ..... 273/402
3,544,109 A 12/1970 Woods
4,169,598 A 10/1979 Taylor
4,260,154 A 4/1981 Balbastro
4,268,029 A * 5/1981 Collins ..... 273/359
4,352,497 A 10/1982 Warehime
4,482,157 A 11/1984 McNeil
4,762,319 A * 8/1988 Krumholz ..... 473/416
4,911,443 A 3/1990 Foster
4,936,578 A 6/1990 Hudson
4,948,147 A 8/1990 Pallanca
4,955,607 A 9/1990 Maye
5,096,191 A * 3/1992 Fang ..... 473/485
5,181,725 A 1/1993 Leras
5,393,069 A 2/1995 Taylor
5,558,338 A 9/1996 Taub
5,588,647 A 12/1996 Rudell
5,613,676 A * 3/1997 Connolly ..... 473/416
5,615,890 A 4/1997 Blue
5,692,979 A * 12/1997 Jones ..... 473/470
5,720,485 A 2/1998 Oswald
5,799,938 A 9/1998 Lewis
5,807,195 A * 9/1998 Westbrook ..... 473/447
5,865,691 A 2/1999 Chen
5,882,271 A * 3/1999 Byrd ..... 473/472
5,908,360 A * 6/1999 Guillont ..... 473/416
5,954,337 A * 9/1999 Cunningham ..... 273/338

(Continued)

*Primary Examiner* — Mitra Aryanpour

(57) ABSTRACT

A sport team game that combines different ball games allowing the athlete to perform at different skill levels, depending on the ball sport team game. The sport team game includes a court having a first end, a second end, a first sideline, a second sideline, a midline passing through a middle point of the court and running from the first sideline to the second sideline and a central circle circumscribed about the center of the midline. Landing strips are located near the end of the court. Trap zones are located near each landing strip. Basket goals are located above each trap zone. Floor goals are located under the basket goals. The three-points line extends around each landing strip. The sport game is played under the rules of at least two different ball games.

4 Claims, 2 Drawing Sheets

(56) References Cited

U.S. PATENT DOCUMENTS

| | | | | |
|---|---|---|---|---|
| 6,149,529 | A | 11/2000 | Fowler | |
| 6,312,348 | B1 | 11/2001 | Sandell | |
| 6,338,686 | B1 | 1/2002 | King | |
| 6,390,940 | B1 * | 5/2002 | Naulls et al. | 473/472 |
| 6,481,451 | B1 | 11/2002 | Zheng | |
| 6,488,600 | B1 * | 12/2002 | Gordon | 473/490 |
| 6,780,129 | B1 * | 8/2004 | Higuchi | 473/447 |
| 6,969,068 | B1 | 11/2005 | Pollon | |
| 7,011,310 | B2 | 3/2006 | Rowan | |
| 7,011,311 | B2 * | 3/2006 | Hochfeld | 473/470 |
| 7,156,762 | B1 | 1/2007 | Rondinelli | |
| 7,247,105 | B2 | 7/2007 | Huntsberger | |
| 7,497,440 | B1 * | 3/2009 | Montgomery | 273/239 |
| 7,507,170 | B1 * | 3/2009 | Steen | 473/472 |
| 7,611,427 | B1 | 11/2009 | Cline | |
| D643,888 | S | 8/2011 | Essex | |
| 2002/0151387 | A1 | 10/2002 | Henson | |
| 2003/0125121 | A1 | 7/2003 | Rhee | |
| 2004/0038759 | A1 | 2/2004 | Kuzia | |
| 2004/0162165 | A1 * | 8/2004 | Tien | 473/447 |
| 2005/0101417 | A1 | 5/2005 | Hamons | |
| 2006/0033282 | A1 | 2/2006 | Fenwick | |
| 2006/0068945 | A1 | 3/2006 | Murchison | |
| 2009/0115136 | A1 | 5/2009 | Voden | |
| 2010/0184536 | A1 | 7/2010 | Kuykindoll | |
| 2010/0261557 | A1 * | 10/2010 | Joseph et al. | 473/433 |
| 2012/0231902 | A1 * | 9/2012 | Storey, III | 473/416 |
| 2013/0165275 | A1 * | 6/2013 | Cerbo | 473/416 |

* cited by examiner

ALLBALL SPORT TEAM GAME

BACKGROUND OF THE INVENTION

The present invention generally relates to sport team games. More particularly, the present invention relates to sport team games for playing a combination of different ball games in the same court.

Several sport team games are known to involve the use of a ball on a court or field. Each of the sport team games has a specific court design, playing equipment, scoring techniques, and rules. Unfortunately, athletes that are usually proficient in one of the ball sport team games are not proficient in the other ball sport team games.

As can be seen, there is a need for a sport team game that combines different ball games, allowing the athlete to perform at different skill levels, depending on the ball sport team game.

SUMMARY OF THE INVENTION

In one aspect of the present invention, a sport team game includes a court having a first end, a second end, a first sideline, a second sideline, a midline passing through a middle point of the court and running from the first sideline to the second sideline and a central circle circumscribed about the center of the midline, landing strips are located near the end of the court, trap zones are located near each landing strip, basket goals are located above each trap zone, floor goals are located under the basket goals, 3-points line extends each landing strip, and the sport game is played under the rules of at least four different ball games.

In another aspect of the present invention, a method of playing a sport team game comprising the steps of: providing a court having a first end, a second end, a first sideline, a second sideline, a midline located on a middle point of the court and running from the first sideline to the second sideline, a central circle located on a center of the midline, a first landing strip located on the first end of the court, a second landing strip located on the second end of the court, a first trap zone located near each one of the first landing strips, a second trap zone located near each one of the second landing strips, a first basket goal located above the first trap zone, a second basket goal located above the second trap zone, a first floor goal located under the first basket goal, a second floor goal located under the second basket goal, a first 3-points line extending from the first landing strip, and a second 3-points line extending from the second landing strip; establishing a set of rules and regulations for the sport team game; allowing a first team of players and a second team of players to move a ball across the court and score points by shooting, kicking, and passing the ball to the floor goals, basket goals, or landing strips; and the points are scored depending on a position of the player shooting, kicking, and passing the ball when the point is scored.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a sport team game that combines different ball games, allowing the athlete to perform at different skill levels, depending on the ball sport team game.

Figure 1:
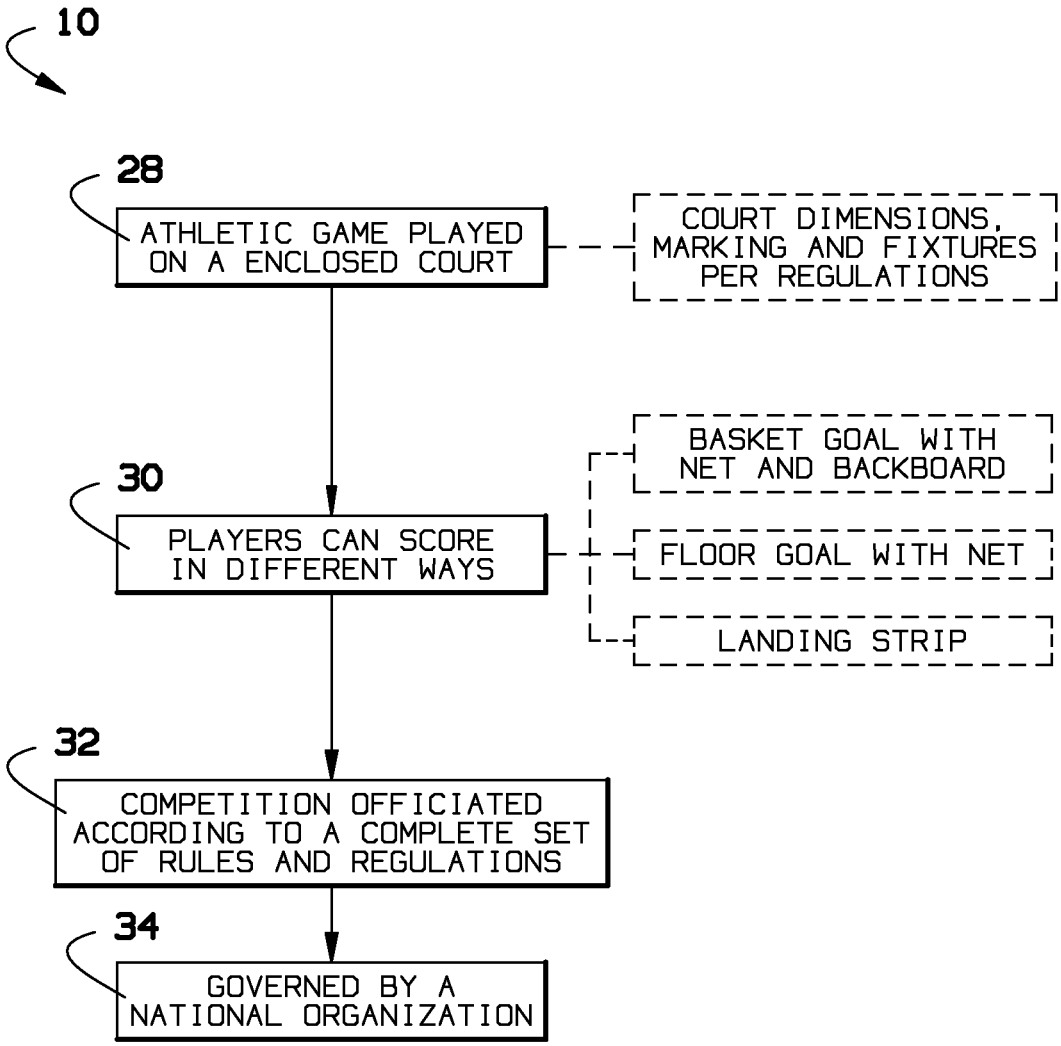
FIG. 1 is a diagram of a sport team game according to an exemplary embodiment of the present invention, showing general facts of the sport team game.

FIG. 1 is a diagram of a sport team game 10 according to an exemplary embodiment of the present invention. The sport team game 10 may be played by two teams with an equal number of players, for example, four players on each team. The sport team game 10 may be played in a court 12 (FIG. 2) under jurisdiction of two or more referees (not shown). The objective of the sport team game 10 may be for one team to score more points than the opposing team.

General facts for the sport team game 10 may include: fact 28—the sport team game 10 may be played on a court 12 (FIG. 2); fact 30—players (not shown) may score in different ways, depending on the type of sport game; fact 32—the sport team game 10 may be governed by specific rules and regulations; and fact 34—the sport team game 10 may be governed by a National Allball Association or a sanctioned Allball League in the youth and amateur sport divisions. Details of the facts 28, 30, 32, 34 may be described along with the description of FIG. 2.

Figure 2:
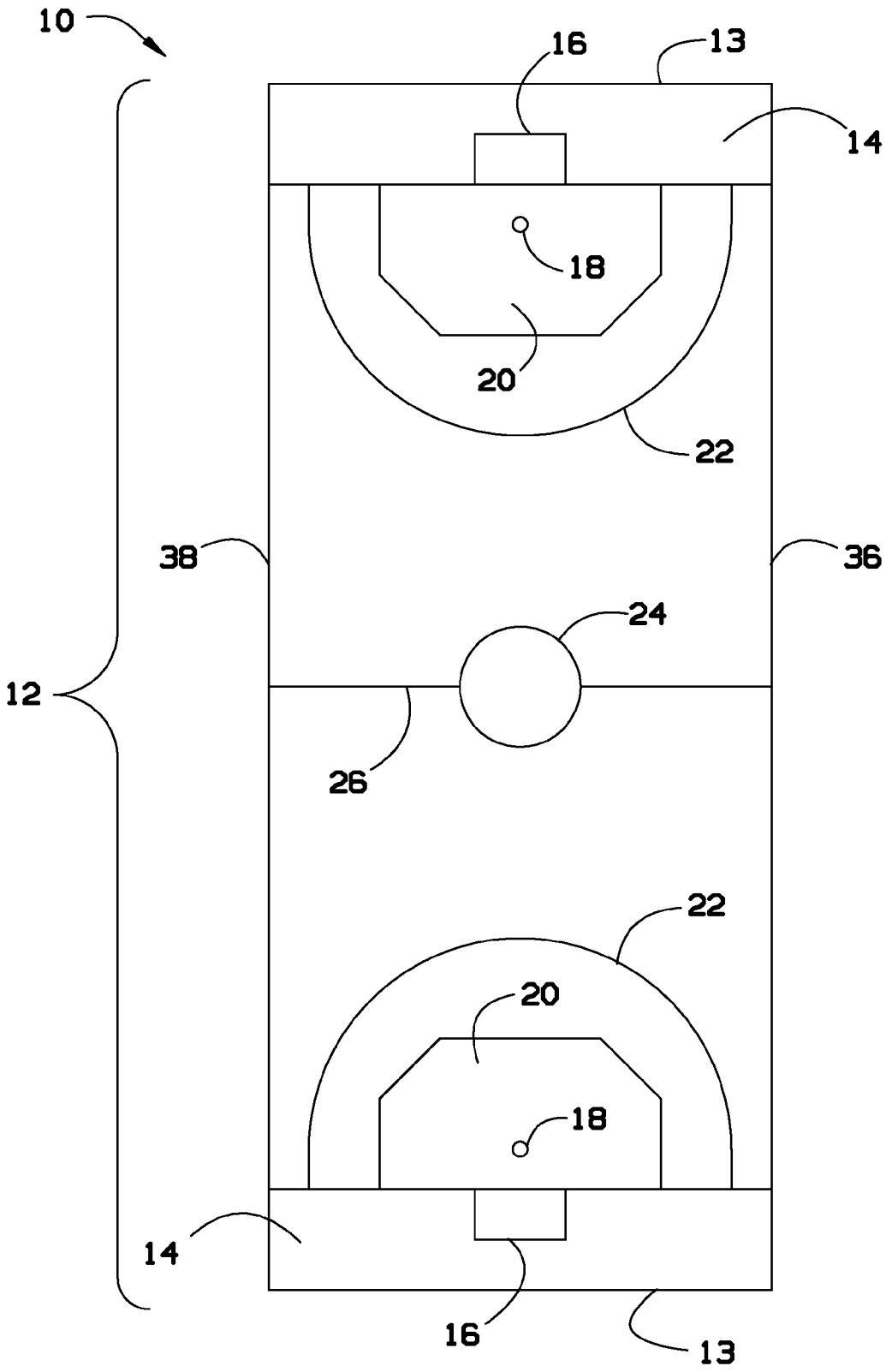
FIG. 2 is a top view of a court used for the sport team game of FIG. 1.

FIG. 2 shows the court 12 used for the sport team game 10. The court 12 may be an enclosed court or an outdoor court. The court 12 may have a rectangular shape with a length of, for example, 100 feet and a width of, for example, 50 feet. A midline 26 may run through the center of the court 12 from a first sideline 36 to a second sideline 38. A central circle 24 may be located on the center of the midline 26. The central circle 24 may have a diameter of, for example, approximately 6 feet. Landing strips 14 may be located on each end 13 of the court 12. Each landing strip 14 may be located approximately 10 feet from the respective end 13 of the court 12. Each end 13 may include a back wall (not shown) to block the ball (not shown) for exiting the court 12. The back wall (not shown) may be, for example, 15 feet high.

Trap zones 20 may be located near each one of the landing strips 14. The trap zone 20 may be standard trap zones for a hockey court. The trap zones 20 may have a shape of a hexagon. The trap zones 20 may extend approximately 28 feet from the landing strip 14.

Basket goals 18 may be located right above each one of the trap zones 20. The basket goals 18 may include a backboard (not shown) with a rim (not shown) attached. The rim (not shown) may be placed approximately 10 feet above the court 12 and may include a net (not shown) attached. The basket goals 18 may be standard basketball baskets.

Floor goals 16 may be placed under each basket goal 18. The floor goals 16 may be a standard soccer goal cage. The floor goal 16 may include a net (not shown). The floor goal 16 used for the professional division may be, for example, 9 feet wide, by 8 feet high, by 5 feet deep, with a top bar of 9 feet in length. The floor goal 16 used for the youth division may be, for example, 7 feet 6 inches wide, by 6 feet high, by 3 feet and 6 inches deep, with a top bar of 7 feet 6 inches in length.

The 3-points line 22 may be a standard 3-points line for a basketball court. The 3-points line 22 may extend from each landing strip 14 of the court 12. The 3-points line 22 may extend, for example, 21 feet from the landing strip 14.

Each team may include a trapper player (not shown) to guard the floor goal 16, a wing player (not shown) for scoring and defending the opponent's goals 14, 16, 18, and a carrier player for moving the ball up and directing the offense. The trapper player may be untouchable inside the trap zone 20.

The sport team game 10 may be played with a ball (not shown) officially approved by the National Allball Association or a sanctioned Allball League. The size of the ball (not shown) may be based on the size and age of the players. The ball (not shown) may be, for example, a size 6 ball for professional and amateur divisions for ages of 15 and older; a size 5 ball for ages 8 through 14; or a size 4 ball for ages 5-7.

Players (not shown) may be required to wear uniforms. The uniforms may include logos, numbers, or last names of the players. Players may be allowed to wear protective equipment (not shown), for example, elbow pads, shin guards, chest guards, helmets, and knee pads.

Some of the rules and regulations are as follows:

Prior to the start of the sport team game 10, the home team may be in charge. Officials (not shown) may have control of the sport team game 10 after the beginning of the game.

The sport team game 10 may begin by a kickoff from the endline of the court 12.

The player may be out of bounds when he/she is touching the ball and any part of his/her body may contact the sideline 36, 38. If a player runs out of bounds, the player may not be the first player to touch the ball when the player returns to the court 12. Face-off may be called out if the opposing players touch the ball as the ball goes out of bounds. The out of bounds ball may be turned over at the spot where it went out of bounds.

The face-offs may be held at the closest trap zone 20 or at the midline 26. The players may kick the ball on the official's whistle. The players may not have their foot in the neutral zone prior to the whistle. No player, other than the two players involved in the face-off, may be inside the central circle 24 of the midline 26 or within 6 feet of the trap zone 20.

After a score, the non-scoring team may take the ball out from beyond the end 13. The ball may be passed and not dribbled or kicked in. The player may run the end 13 in order to inbound the ball. When at the end 13, each player may have five seconds to get the ball in. The player may also run the sidelines 36, 38 from the midline 26 to the end 13, as long as the ball may be thrown in within five seconds. The inbound player may not step on the court 12 before the release of the ball. The inbound player may have at least one foot in the landing strip 14 or on the sidelines 36, 38. If the inbound ball pass lands out of bounds before touching another player, the ball may be returned to the original throw-in spot and turned over to the opposing team. A teammate may switch spots with an inbound player, provided that they receive the ball out of bounds via a hand-off or a pass. A wall pass or bounce pass may be permitted.

Players may score points by shooting the ball into the basket goal 18, throwing or kicking the ball into the floor goal 16, or throwing or kicking the ball into the landing strip 14. The amount of points scored may depend on the distance of the shot to the goal. Scoring points may range from two to ten. The ball may enter the floor goal 16, the basket goal 18, or landing strip 14 completely to be counted as a scored point. A ball, that may be partially in or knocked out, may not count as a scored point. Players may not score points by shooting from outside the sidelines 36, 38 to the basket goal 18, floor goal 16, or landing strip 14, unless it deflects or touches a teammate or opponent first. Players may shoot from the landing strip 14 into their offensive basket goal 18 scoring two points. If a ball hits the back of the backboard (not shown) and enters the basket goal 18, the player may score two points. Players may shoot or throw the ball into the floor goal 16 or the goal basket 18 from inside the 3-points area 22 and outside the trap 20 scoring two points. A shot may not be kicked in the floor goal 16 or basket goal 18 from inside the 3-points area 22. Players may shoot, kick, or throw the ball into the floor goal 16 or the goal basket 18 from outside the 3-points line 22 and inside the midline 26, scoring three points. Players may shoot, kick, or throw the ball into the floor goal 16 or the goal basket 18 from outside the midline 26 and inside the opposite 3-points line 22 scoring five points. Players may shoot, kick, or throw the ball into the floor goal 16 or the goal basket 18 from inside the opposite 3-points line 22, scoring seven points. Also, landing plays from this area. Players may shoot, kick, or throw the ball into the floor goal 16 or the goal basket 18 from the opposite landing strip 14 scoring ten points. Also, landing plays from this area. If a player knocks the ball into their own floor goal 16 or basket goal 18, the player may score two points and credit to the last opposing player to touch the ball. If a shot hits the rim (not shown) or backboard (not shown) and inadvertently enters the goal without being touched by either team, the player may score two points. If a pass or shot hits the back of the backboard (not shown) and goes inside the floor goal 16, the player may score two points.

Landing plays may be passed from anywhere outside the midline 26 to a teammate inside the landing strip 14. Passes may be kicked, thrown, or headed to a teammate. At no time may the ball touch the court 12 or any other object. The ball may be deflected by a defensive player (not shown) and caught. If the ball is deflected by an offensive player (not shown) and caught, no points may be awarded. Passes may be completed as long as the receiving player catches the ball with both feet landing inside the landing strip 14 with possession.

When the shot may be deflected by an offensive player (not shown) on the way to the goal 14, 16, 18, the scored point may be calculated from the deflected area, not the origination of the shot. When the shot may be deflected by a defensive player (not shown) on the way to the goal 14, 16, 18, the scored points may be awarded from the origination of the shot.

Fouls may not be allowed when playing the sport team game 10. If a foul occurs while shooting into the basket goal 18 or the floor goal 16, the fouled player may take two foul shots from anywhere on the court 12. If the player is passing the ball on the landing strip 14 and is fouled, the player may be awarded two shots. Players may not impede the progress of an opposing player by holding, tripping, pushing, charging into, force from behind or extending an arm, leg, or knee. The player may not swing elbows in an excessive manner. If contact is made, during elbow swinging, a foul may be called. Contact on the trapper in the trap 20 may allow the player two foul shots. The foul shots may be taken by any player on the court 12. No foul may be called during the following; a defender applying contact with a hand, forearm, or body, as long as it did not include excessive elbow swinging. If the foul occurs while the player is not shooting, the ball may be taken out on the sideline 36, 38 closest to the occurrence by the fouled team. If a player may be going for a pass and may contact another player, then there is no foul. If the player may make contact with another player, while not going for the ball, then there may be a foul.

A Technical Foul may be considered when the player argues in an overly aggressive manner, bumping, pushing or abusing an official. The player may be removed from the sport team game 10 after two technical fouls in the same game. Technical fouls may not be charged as a team foul. Offensive fouls may be considered when the player charges into, elbows, or uses force on another player. If a double foul occurs, both players and teams receive a foul and there may be a face-off between the two players at the midline 26. No foul shots. A player may be disqualified once they receive five fouls in the same game or a second technical foul.

Players fouled in the act of shooting may be awarded two foul shots. The foul shots may be shot from anywhere on the court 12. The player may indicate which one of the goals 14, 16, 18 he/she may be shooting. The player may be allowed one step before shooting or kicking when attempting a foul shot. Each team may be allowed eight fouls per period. After that, each foul shot may be considered a bonus. Team fouls may be reset at the end of each period. Non-shooting players may stay outside the sidelines 36, 38 and may not enter the court 12 until the second foul shot has left the shooter's hand or foot. If the shooting team releases from the sideline 36, 38 prematurely, the foul shot may be nullified and turned over to the other team. If the defense team releases early from the sideline 36, 38 and the shot is made, there may be no penalty. If the shot is missed, an additional shot may be added. If the wrong offensive player inadvertently takes a foul shot, the shot may be nullified and turned over to the other team.

Goaltending may not be permitted if the ball is on its way down to the basket goal 18, but may be permitted if the ball has already touched the rim and may be knocked off. The ball may not be returned through the bottom of the net.

Players may only hold the ball for 5 seconds without passing, dribbling or shooting. Violations may result in a turnover and taken out on the closest side. Players may not hold and/or dribble the ball without passing or shooting for more than ten seconds. Results may be a turnover and taken out on the closest side.

A substitute player may enter the sport team game 10 during a break after being summoned in by the official. There is no limit to the amount of subs that may be used in the sport team game 10. The official may have the right to refuse the substitution. The substitute player may not replace the foul shooter. The substitute player may remain in the sport team game 10 until the ball may be played and touched by the player on the court 12, unless a foul may be called prior to. Substitute violations may result in a technical foul to the illegal substitute. If too many players have been disqualified or ejected and the team is out of subs, the sport team game 10 may continue with a shortage of players.

Some of the terms and definitions are as follows:

Back Trap Pass—A pass behind the floor goal

Back Wall—Wall at the back of the court on both ends

Bonus—1 foul shots for each foul over the 7 per team per period limit.

Carrier—Player who brings the ball up and directs the offense

Double Dribble—Bouncing the ball with two hands, or starting your dribble after it has been stopped Drop Kick—Holding the ball then dropping it to the court and kicking it End Zone—The area on the court where points can be scored via a pass. The End Zone is found at both ends of the court. Also, the area to in bound the ball after a score.

Gap Line D—Zone Defense along the center of the hex. Defenders are spread wide leaving a gap in between each other Illegal Roster—Having a player on your bench or on your roster that is not registered In For a Landing—Completed pass to a receiver.

LSP—Pass to a receiver in the landing strip.

Man to Man—Defense where each player is covered by one player

Neutral Zone—Area kept clear during a face-off

Offensive Foul—Aggressive move against a defender

Over the Line—Kicking team player crosses the endline before the ball is kicked

Press—Full court defensive pressure

Scoring Area—Designated zone to score various points

Scoring Line—The line that separates each scoring area

Side Ball—Ball thrown in from the sidelines that was deflected out of bounds

Sudden Death—Possession by both teams at the end of the overtime period

Safety—Player who guards the floor goal

Technical—Foul for an over aggressive play, or arguing with an official

Timeouts—A break in action called by a particular team

Traveling—Player moving with the ball without dribbling

Trap—Area in front of the floor goal

Triangle D—Zone Defense with a player at the top of the hex and a wing on each side Tri Line D—Zone Defense along the top of the hex. Defenders are 3 across in a tight formation Wall Pass—Passing to a teammate using the back wall Wing—Offensive player who plays on the outer portion of the offense Deuce—2 point shot 3 Ball—3 point shot Nickel—5 point shot Lucky Ball—7 point shot Dime—10 point shot Full Count—5 point pass attempt Big Red—7 point pass attempt Hard Ten—10 point pass attempt Some of the reasons for game time delay may be as follows:

Kicking or throwing the ball away from an official.

Kicking or throwing the ball away from an opponent.

Not entering or leaving the floor within 15 seconds of a substitution.

Spending more than the allotted time in a time out.

Throwing the ball into the stands.

Taking more than 10 seconds to shoot a foul shot.

Excessive celebration.

Delay of Game penalty is a technical foul.

Some of the sport team game timing may be as follows:

The Professional and Amateur Divisions, ages 15 and above, may play 5, 11 minute periods. The Junior Division 11-14 years of age, may play 5, 9 minute periods. The Rookie Division may play 5, 8 minute periods.

There may not be a shot clock.

If the game ends in a tie, then a one possession game called sudden death may begin. First team to score the most points may be declared the winner. Each team may have equal possessions. The game may continue until there is a winner.

Two minutes may be permitted between periods.

Teams may permitted 20 seconds to replace a disqualified player.

The game clock may be equipped to show tenths of a second during the last minute of each period.

Teams may 5 seconds to inbound the ball. Shots may not be taken from out of bounds.

If a shot may be attempted at the sound of the final buzzer, the shot may be released before the buzzer sounds or the shot may be nullified.

If there is a foul as the buzzer sounds, the period may end when the foul is penalized.

Each team may be allowed 8 timeouts in a game. Sudden Death may permits 1 time out per team.

Timeouts may be 90 seconds.

If a team is out of timeouts and a player or coach calls one, a technical foul may be granted to the opposing team. The technical foul may be charged to whoever called time out.

Timeouts may be called only by the offensive team while the ball is in play. A defensive timeout may be called while the offensive team is inbounding the ball, or in between foul shots. Offensive team may call a timeout during an inbounding.

Teams may not call a timeout after a timeout if the ball has not been put in play. Violation may be a turnover.

Only players on the court may call a timeout.

Clock stops at fouls, foul shots, injuries, timeouts and balls out of play. Restarts when in bounded and touch by a player on either team.

After a timeout, the ball may be spotted at the nearest sideline. The location is determined by the spot of the ball when a timeout was granted.

Some of the requirements for officials are as follow:

All officials may be certified by the National Allball Association in order to referee an Allball game.

The NAA may have the right to dismiss an official based on actions detrimental to the association.

Officials may have the right to make decisions to protect the integrity of the game.

Officials may be reviewed on an annual basis.

NAA Officials may wear the shirts with the NAA logo on the front and 2 color 6" number on the back, pants and sneakers.

Prior to the start of the game the officials may inspect and approve all equipment, including court, baskets, nets, goals, timers, and balls.

Two to three officials may be required for all games from the age of 10 and up.

Players may not be permitted to wear any jewelry, including earrings.

Officials may not permit any player to wear equipment that in their judgment is dangerous to other players. Casts, splints, braces or guards must be padded. Equipment approval may be on a game by game basis. Equipment that is designed for advantage such as height or reach may not be permitted.

Head official may check the rosters of both teams 15 minutes before the start of the game.

Team captains may meet with officials at the midline prior to the start of the game.

Game Balls need to be supplied by the home team. Each team may have at least 5 balls for warm ups.

Officials may report any atypical or unusual incidents to the league office.

If there is a difference of opinion between officials, a conference may required to re-enact the play and make the correct call.

If, both teams commit a foul at the same time, the fouls may be counted. Then a face off at the midline between the two.

When a foul or violation occurs the official may blow his whistle to stop the play. Indicate the violation and the number of the player that committed the foul. If no foul shots are required then the spot of the inbound may be provided.

If there is inadvertent whistle, play stops and the ball may be brought to the nearest side line for a throw in.

Referees may have an annual membership fee to participate in NAA games.

A referee may not officiate any league game that he is a registered player in.

It should be understood, of course, that the foregoing relates to exemplary embodiments of the invention and that modifications may be made without departing from the spirit and scope of the invention as set forth in the following claims.

What is claimed is:

1. A sports-court having a first end, a second end, a first sideline, and a second sideline;

a midline passing through a middle point of the court and extending from the first sideline to the second sideline, wherein the midline represents a 5-point scoring area;

a central circle circumscribed about a center of the midline; wherein the center circle serves as a face off area;

a first landing strip is located at a first end of the court; the first landing strip forming a rectangular area which extends between the first sideline and the second sideline and is parallel to a first back wall;

a second landing strip located at a second end of the court opposite the first end; the second landing strip forming a rectangular area which extends between the first sideline and the second sideline and is parallel to a second back wall;

a first hexagonal shaped trap zone which extends between the first end line and the second end line and extends 15' beyond the perimeter of the court the first hexagonal shaped traps zone having a 28' width and two 9' angles on each side; the first hexagonal shaped trap zone is positioned directly in front of the first landing strip;

a second hexagonal shaped trap zone which extends between the first end line and the second end line and extends 15' beyond the perimeter of the court, the second hexagonal shaped traps zone having a 28' width and two 9' angles on each side; the first hexagonal shaped trap zone is positioned directly in front of the first landing strip;

a first octagon shape basket goal and a first backboard located above the first trap zone;

a second octagon shape basket goal and a second backboard located above the second trap zone; wherein the octagon shape of the first and second basket goals makes defending the first and second basket goals more challenging;

a first 3-points line extending from the first landing strip;

a second 3-points line extending from the second landing strip; and wherein the first and second goals and the first and second baskets serve as a scoring vehicle as well as a passing opportunity and defense mechanism of the first and second octagon shaped basket goals.

2. The Sports Court of claim 1, wherein the first and second trap zones extend 28 feet along the first and second end lines and stretch to 15 feet at the top of the hexagonal area;

the trap zones are restricted areas where an offensive player may not attempt a shot;

the trap zones also provide a safety area for a trapper (goalie); and wherein no player may touch the trapper or attempt a shot in the trap zone.

3. The Sports Court of claim 1, wherein 3-point lines provide a scoring area of 3 points, the 3-point lines range from the arc to the midline;

beyond the midline provide a scoring area of 5-points; and wherein the 3-point line permits a player to make a kicking attempt on the first and second basket goals; and wherein players may not kick a shot from inside the 3-point line.

4. The Sports Court of claim 3, wherein the first and second basket goals provide for several uses;

scoring points by kicking, shooting, or throwing a ball into the first or second basket goals; utilizing the first and second baskets as a passing mechanism to provide players with additional options to score; and use of the first and second baskets and the first or second goals provide an additional form of defense from a player attempting to score from behind the goal while positioned in the first or second landing strip areas.

* * * * *